US007329380B2

(12) United States Patent
Yu

(10) Patent No.: US 7,329,380 B2
(45) Date of Patent: Feb. 12, 2008

(54) METHOD OF CONTROLLING THE DIMENSIONAL CHANGE WHEN SINTERING AN IRON-BASED POWDER MIXTURE

(75) Inventor: Yang Yu, Höganäs (SE)

(73) Assignee: Höganäs AB, Höganäs (SE)

( * ) Notice: Subject to any disclaimer, the term of this patent is extended or adjusted under 35 U.S.C. 154(b) by 210 days.

(21) Appl. No.: 10/530,398

(22) PCT Filed: Oct. 15, 2003

(86) PCT No.: PCT/SE03/01595

§ 371 (c)(1),
(2), (4) Date: Aug. 5, 2005

(87) PCT Pub. No.: WO2004/038054

PCT Pub. Date: May 6, 2004

(65) Prior Publication Data

US 2006/0073064 A1 Apr. 6, 2006

(30) Foreign Application Priority Data

Oct. 23, 2002 (SE) ..... 0203135

(51) Int. Cl.
*B22F 3/12* (2006.01)

(52) U.S. Cl. ..... 419/11; 419/36; 419/38

(58) Field of Classification Search ..... 419/39, 419/11, 32, 36, 38; 75/246
See application file for complete search history.

(56) References Cited

U.S. PATENT DOCUMENTS 3,694,173 A 9/1972 Farmer et al.
3,752,712 A 8/1973 Holcomb et al.
5,082,433 A * 1/1992 Leithner ..... 419/11
6,068,813 A 5/2000 Semel
6,261,389 B1 * 7/2001 Nakamura et al. ..... 148/332
6,620,218 B2 * 9/2003 Mårs et al. ..... 75/246

FOREIGN PATENT DOCUMENTS

| | | |
|---|---|---|
| GB | 680275 | 10/1952 |
| WO | WO 91/10753 | 7/1991 |
| WO | WO 02/059388 | 8/2002 |

* cited by examiner

*Primary Examiner*—Roy King
*Assistant Examiner*—Ngoclan T. Mai
(74) *Attorney, Agent, or Firm*—Buchanan Ingersoll & Rooney PC

(57) ABSTRACT

The invention concerns a method of controlling the dimensional change to a predetermined value including the steps of providing a first powder (A) consisting of an iron based powder (1) and copper in the form of elemental copper (2), or copper diffusion-bonded to the iron-based powder (3); providing a second powder (B) consisting of the iron-based powder (1) and a pre-alloyed iron-copper powder (4); mixing the first and second powder mixtures (A) and (B) in proportions resulting in the desired dimensional change adding graphite and lubricant and optionally hard phase materials and other alloying elements to the obtained mixture; compacting the obtained mixture; and sintering the compacted body.

2 Claims, 3 Drawing Sheets

Figure 1:
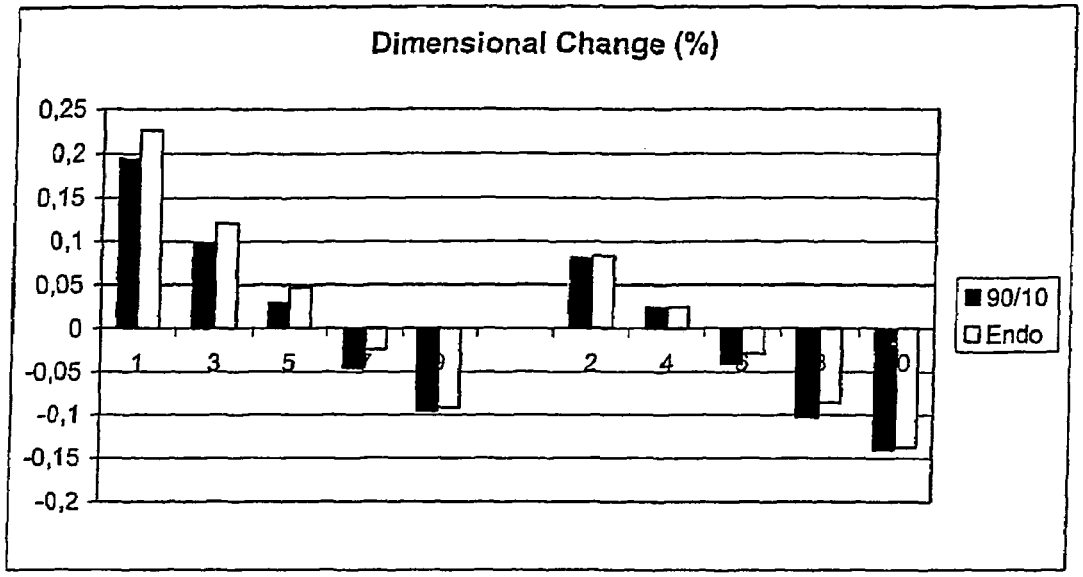

METHOD OF CONTROLLING THE DIMENSIONAL CHANGE WHEN SINTERING AN IRON-BASED POWDER MIXTURE

The present invention concerns mixtures of iron-based powders. Particularly the invention concerns a method of controlling the dimensional change during sintering of compacts, which are prepared from such mixtures.

Sintering of powder metallurgically prepared compacts based on iron or iron with alloying elements normally results in a dimensional change, i.e. the dimensions of the sintered product deviate from those of the compact. The dimensional change is an obvious problem as various degrees of machining will then be necessary in order to obtain the identical sintered parts required in mass production.

The variation in dimensional change during sintering is particularly pronounced when copper is included in the compact. Copper is widely used as an alloying element due to its hardening effect. In contrast to most other elements, copper causes swelling when it is included in the powder to be compacted. Dimensional variation or instability caused by swelling during sintering of Fe—Cu and Fe—Cu—C-powder compacts have been studied for the past few decades. Different mechanisms have been suggested in order to explain the swelling of the compact during the sintering. Thus, Bockstiegel, (Metallurgia, 1962, 3 (4), 67) proposed that the volume increase in Fe—Cu compacts during sintering was caused by solid state diffusion of Cu into the grains, leaving large pores at the original copper sites. Dautzenberg (Arch. Eisenhuttenwes., 1970, 41, 1005) conducted dilatometric studies and kinetic calculations and explained, on the basis of these studies, that diffusion alone could not be responsible for the rapid volumetric growth during sintering. The rapid expansion observed in the compacts was explained to be the effect of penetration of molten copper into the particle boundaries and along some of the grain boundaries inside the iron particles. The swelling effect of copper in different iron powders has been studied by several researches as for example Tabeshfar and Chadwick, (Powder Metall., 1984, 27, 19-24), who showed that the internal porosity left in iron particles after compaction effected the degree of swelling.

Within the patent literature the dimensional change has been addressed to in e.g. the U.S. Pat. No. 5,567,890 which discloses an iron based powder including Ni, Mo and C for producing highly resistant components with small local variation in dimensional change. The dimensional change of components produced by this powder composition is fairly independent of the sintered density and the carbon or molybdenum content. In these iron-based compositions copper can only be present as an impurity. The U.S. Pat. No. 5,507,853 suggests a method of improving the dimensional stability of the iron-copper-carbon system by controlling the diffusion of graphite into the iron particle by adding selected oxides.

The Japanese patent application 53-146 204 describes an iron-copper-carbon sintered alloy, with good mechanical characteristics and dimensional accuracy. The copper swelling is suppressed by adding the copper as a prealloyed iron-copper powder.

In commercial powder metallurgical production dimensional change in sintered iron-copper-carbon parts is generally controlled by adding graphite to a combined carbon content of about 0.5 to about 0.8%. Addition of graphite to a iron-copper system has a diminishing effect on the copper swelling and typically the growth can be kept below 0.4%.

By changing the particle size of added graphite the dimensional change can further be controlled within certain limits.

There is however a need of controlling the dimensional change within a wide limit without changing the chemical composition of the sintered compact and without adding large amounts of graphite or manipulating with the particle size of graphite. This is especially important when the same tool is used for plain iron-copper-carbon system as for high strength material, such as iron-molybdenum-copper-carbon, which is difficult to machine to right dimensions after sintering.

An object of the present invention is to provide a method of controlling the dimensional change during sintering for systems including copper and optionally also carbon and molybdenum. By the method according to the invention the dimensional change during sintering may be controlled to a predetermined value without changing the chemical composition. The possibility of predicting the dimensional change will reduce the need for machining and accordingly the cost of the final parts.

According to the invention the method of controlling the dimensional change to a predetermined value includes the steps of providing a first powder (A) consisting of an iron based powder (1) and copper in the form of elemental copper (2), or copper diffusion-bonded to said iron-based powder (3);

providing a second powder (B) consisting of said iron-based powder (1) and a pre-alloyed iron-copper powder (4);

mixing said first and second powder mixtures (A) and (B) in proportions resulting in the desired dimensional change;

adding graphite and lubricant and optionally hard phase materials and other alloying elements to the obtained mixture;

compacting the obtained mixture; and sintering the compacted body.

The actual proportion can easily be determined by the man skilled in the art by small scale laboratory experiments or by using full scale production equipment.

According to a preferred embodiment of the invention the iron-based powder (1) is an iron powder which is prealloyed with molybdenum.

In order to keep the same chemical composition for the mixtures and the sintered components produced from the mixtures with different proportions of the first powder A and the second powder B, the copper content of the first powder shall be the same as the copper content of the second powder. This can be achieved either by adjusting the Cu content of the powder A or adjusting the copper content of powder B. The copper content of powder B can be adjusted either by adjusting the proportions between powder (1) and powder (4) or adjusting the copper content of powder (4).

In order to obtain compacts having satisfactory mechanical properties according to the present invention it may be necessary to add minor amounts of graphite to the powder mixture to be compacted. Thus graphite in amounts between 0.1-1, preferably 0.2-1.0 and most preferably 0.2-0.8% by weight of the total mixture to be compacted could be added before the compaction.

The powder mixture is also preferably combined with a lubricant before it is transferred to the die. Examples of suitable lubricants are e.g. stearates, waxes, oligomers, polymers etc. The lubricants are preferably added in the form of particles but may also be bonded to the particles. According to the present invention the amount of lubricant added to the iron-based powder may vary between 0.05 and 1.5%, preferably between 0.1-1.0% by weight of the mixture.

The compaction may be performed with standard equipment, at ambient or elevated temperature and the sintering may be performed at the temperatures normally used within the PM field, e.g. at low temperature such as 1100-1140° C. or higher temperatures such as 1250° C. and in conventionally used atmospheres.

An additional advantage by using the method of controlling the dimensional change according to the present invention is that annular composites consisting of one outer and one inner annular compact having the same chemical composition but different dimensional change may be produced. This makes it possible to achieve a firm bonding between the inner compact and the outer compact.

EXAMPLE

Astaloy Mo, (available from Höganäs AB, Sweden) is a water atomised iron based powder pre-alloyed with 1.5% of molybdenum. Astaloy Mo having 2% by weight of copper diffusion bonded is also available from Höganäs AB as Distaloy DH-1. Distaloy DH-1 is in the following referred to as powder A.

Astaloy Mo mixed with 10% of Astaloy 20 Cu, which is a water atomised iron powder prealloyed with 20% of copper and which is also available from Höganäs AB) was used as powder B.

Ten mixes were prepared with different proportions of powder A and powder B and different graphite contents. 0.6% of Kenolube™ lubricant was added to all the mixes. The following mixes were made:

| Mix no | Proportion of powder A % | proportion of powder B % | graphite % |
|---|---|---|---|
| 1 | 100 | 0 | 0.4 |
| 3 | 70 | 30 | 0.4 |
| 5 | 50 | 50 | 0.4 |
| 7 | 30 | 70 | 0.4 |
| 9 | 0 | 100 | 0.4 |
| 2 | 100 | 0 | 0.6 |
| 4 | 70 | 30 | 0.6 |
| 6 | 50 | 50 | 0.6 |
| 8 | 30 | 70 | 0.6 |
| 10 | 0 | 100 | 0.6 |

After mixing and addition of lubricant fourteen tensile test samples for each mix were moulded, with a mould pressure of 600 MPa in a uniaxial press movement. Seven of the produced tensile test samples of each mix were then sintered at 1120° C., for 30 minutes, in an atmosphere of 90% $N_2$/10% $H_2$ with a carbon potential of 0.2% and the rest of the tensile test samples were sintered in endogas atmosphere, at 1120° C., for 30 minutes, with a carbon potential of 0.5%.

Dimensional change and mechanical properties of the samples were measured and the mean value based on seven samples treated during the same process conditions, were calculated.

FIG. 1 shows the value of dimensional change from samples produced from mixes with different proportions between powder A and powder B. The figure shows that a very accurate predetermined value, in the range from +0.2% to −0.14%, of the dimensional change can be reached by changing the proportions of powder A and powder B.

Figure 2:
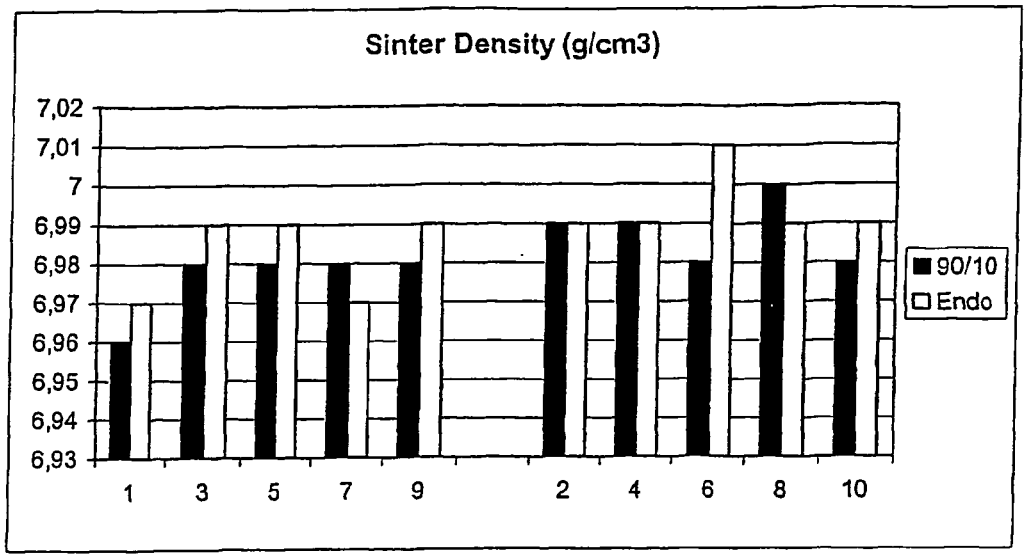
Figure 3:
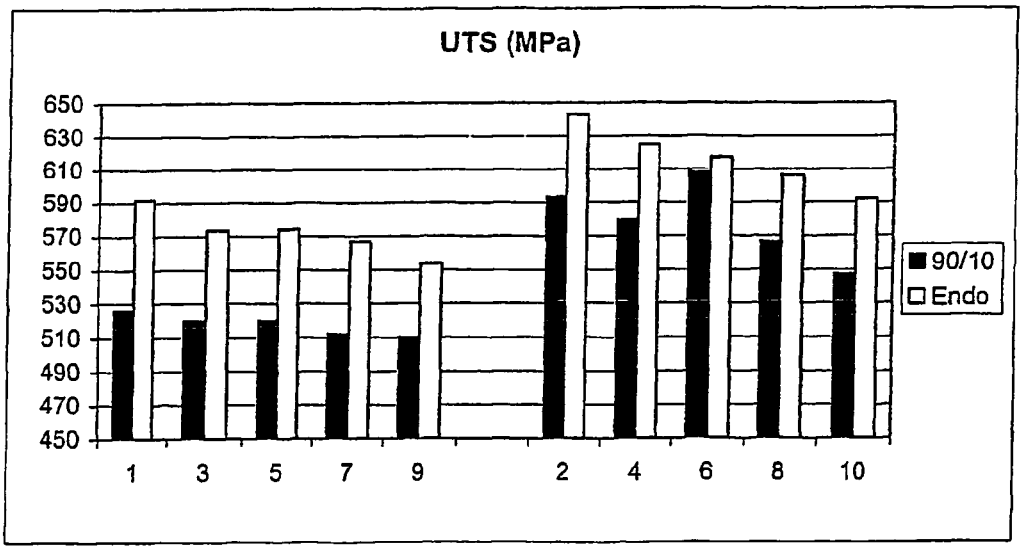
Figure 4:
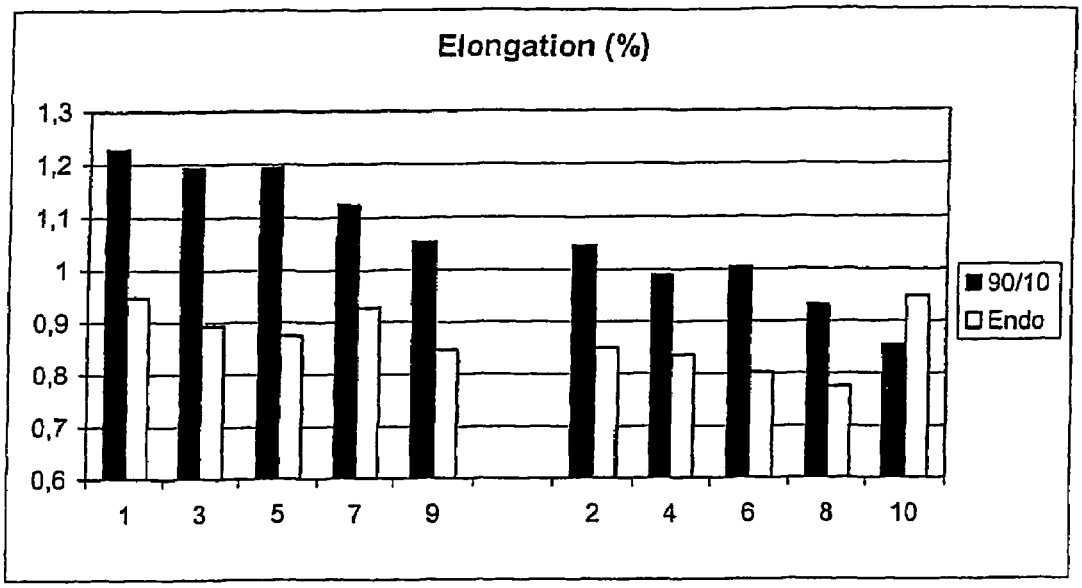
Figure 5:
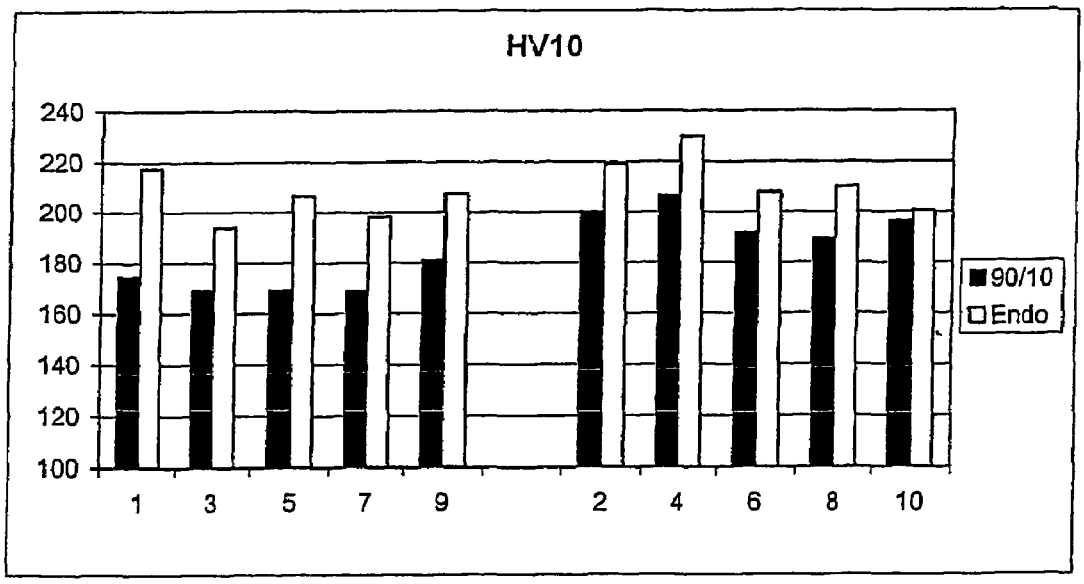

FIG. 2 shows the mean value of the sintered density, FIG. 3 shows the mean value of the ultimate tensile strength, FIG. 4 shows the mean value of elongation and FIG. 5 shows the mean value of the hardness for seven samples produced from the same mix and sintered under the same conditions. The figures show that the variations in sintered density, tensile strength, elongation and hardness are very small and within tolerable limits.

The invention claimed is:

1. A method of controlling the dimensional change to a predetermined value when sintering a compacted body of a powder mixture comprising:

providing a first powder (A) consisting of an iron based powder (1) and copper in the form of elemental copper (2), or copper diffusion-bonded to said iron-based powder (3);

providing a second powder (B) consisting of said iron-based powder (1) and a pre-alloyed iron-copper powder (4); wherein the copper content of powder B is made equal to the copper content of powder A either by adjusting the Cu content of the powder A or adjusting the copper content of powder B, whereby the copper content of powder B is adjusted either by adjusting the proportions between powder (1) and powder (4) or by adjusting the copper content of powder (4);

mixing said first and second powder mixtures (A) and (B) in proportions resulting in the desired dimensional change, adding graphite and lubricant and optionally hard phase materials and other alloying elements to the obtained mixture;

compacting the obtained mixture to a compacted body; and sintering the compacted body.

2. The method according to claim 1 wherein the iron based powder (1) is an iron-molybdenum pre-alloyed powder.

* * * * *